US006877515B2

(12) United States Patent
Heitmann et al.

(10) Patent No.: US 6,877,515 B2
(45) Date of Patent: Apr. 12, 2005

(54) METHOD OF MAKING A TOBACCO ROD

(75) Inventors: Uwe Heitmann, Hamburg (DE); Heinz-Christen Lorenzen, Wentorf (DE)

(73) Assignee: Hauni Maschinenbau AG (DE)

( * ) Notice: Subject to any disclaimer, the term of this patent is extended or adjusted under 35 U.S.C. 154(b) by 259 days.

(21) Appl. No.: 09/976,291

(22) Filed: Oct. 15, 2001

(65) Prior Publication Data

US 2002/0043268 A1 Apr. 18, 2002

(30) Foreign Application Priority Data

Oct. 14, 2000 (DE) ..... 100 51 031

(51) Int. Cl.[7] ..... A24C 5/18

(52) U.S. Cl. ..... 131/84.2; 131/84.2; 131/84.1; 131/110; 131/109.2

(58) Field of Search ..... 131/84.1, 110, 131/84.2, 280, 84.3, 84.4, 109.2

(56) References Cited

U.S. PATENT DOCUMENTS 3,282,270 A 11/1966 Morris et al.
4,003,385 A * 1/1977 Adebahr et al. ..... 131/84.3
4,281,670 A 8/1981 Heitmann et al.
4,721,119 A 1/1988 Ludszeweit et al.
5,125,419 A 6/1992 Heitmann

FOREIGN PATENT DOCUMENTS

DE 3919720 12/1990

* cited by examiner

*Primary Examiner*—Dionne A. Walls
(74) *Attorney, Agent, or Firm*—Venable LLP; Robert Kinberg; Chad Anderson

(57) ABSTRACT

Apparatus for making one or more rod-like fillers of shredded tobacco for use in the making of cigarettes or the like employs one or two pneumatic conveyors having endless foraminous belts trained over pulleys and including elongated stretches below communicating parts of a common suction chamber. A shower of intermixed tobacco shreds and smaller particles including tobacco dust and coarser particles is directed against the undersides of the elongated stretches. The shreds are attracted to and advance with the respective belts to form streams which are ready to be trimmed and thereupon draped into cigarette paper or the like. At least some smaller particles penetrate through the respective belts into the corresponding parts of the suction chamber. The contents of the suction chamber are evacuated by suction and are returned to the undersides of the elongated stretches of the belts for classification.

5 Claims, 4 Drawing Sheets

METHOD OF MAKING A TOBACCO ROD

CROSS-REFERENCE TO RELATED CASES

This application claims the priority of the commonly owned copending German patent application Serial No. 100 51 031.0 filed Oct. 14, 2000. The disclosure of the above-referenced German patent application, as well as that of each US and foreign patent and patent application identified in the specification of the present application, is incorporated herein by reference.

BACKGROUND OF THE INVENTION

The present invention relates to improvements in methods of and in apparatus for making tobacco rods. More particularly, the invention relates to improvements in methods of and in apparatus for making one or more continuous rod-like bodies, called fillers, which can be converted into tobacco-containing parts of plain or filter cigarettes, cigars, cigarillos or analogous smokers' products.

It is well known to make the rod-like filler of a cigarette by showering particles of tobacco (such as shreds of tobacco leaf laminae) which is supplied by a so-called distributor or hopper onto the exposed side of a running sieve-like endless foraminous belt while the other side of the belt travels along the open side of a stationary suction chamber. This results in conversion of the shower into a stream which contains a surplus of tobacco particles and moves lengthwise with the belt past a trimming or equalizing device which removes the surplus. The resulting rod-like filler is confined in a running continuous web of cigarette paper or other suitable wrapping material to form therewith a continuous rod which is severed at regular intervals to yield a succession of plain cigarettes of unit length or multiple unit length. Such products are ready to be confined in packs or to be provided with filter mouthpieces to form therewith filter cigarettes of unit length or multiple unit length. The making of plain or filter cigarillos, cartridges, cigars or analogous smokers' products involves or can involve procedures or steps similar to those involving the making of plain or filter cigarettes. Conventional machines for the making of plain and filter cigarettes are disclosed, for example, in U.S. Pat. No. 4,281,670 granted Aug. 4, 1981 to Heitmann et al. for "APPARATUS FOR INCREASING THE PERMEABILITY OF WRAPPING MATERIAL FOR ROD-SHAPED SMOKERS' PRODUCTS".

It is also known to segregate particles of tobacco dust or analogous less desirable fragments of smokable material from the much more desirable elongated shreds of tobacco leaf laminae and/or from the atmosphere in a cigarette making plant. The thus segregated particles can be utilized for the making of sheets or films of reconstituted tobacco. Alternatively, such less desirable particles of dust or the like can be introduced into the tobacco stream which is borne by the foraminous belt; such introduction takes place prior to removal of the surplus, i.e., prior to conversion of the tobacco stream into a rod-like filler. The purpose of such introduction of tobacco dust and/or like particulate material into the tobacco stream is to contribute to the weight, bulk, density, "feel" and/or other desirable characteristics of smokers' products embodying lengths of the filler. It is normally preferred to remove all or practically all particles of tobacco dust from the shower or showers of tobacco particles (normally shreds) which are being conveyed to the stream-forming station.

It is equally known to evacuate from the aforementioned suction chamber of a cigarette rod making machine all or practically all particles of tobacco dust. The term "dust" is intended to embrace all such particles of tobacco and/or foreign matter entrained by full-sized tobacco shreds which do or can consist of a smokable material but are often too small to allow for appropriate interlacing with genuine tobacco shreds. The thus gathered particles of tobacco dust, as well as relatively small or very small shreds, are admitted into the tobacco stream.

It is further known to simultaneously produce a plurality of (particularly two) continuous cigarette rods each of which yields a series of plain cigarettes of unit length. Reference may be had, for example, to commonly owned U.S. Pat. No. 5,125,419 granted on Jun. 30, 1992 to Heitmann for "METHOD OF AND APPARATUS FOR MAKING PLURAL TOBACCO STREAMS". Such arrangement multiplies the output of the cigarette making machine with two or more foraminous tobacco rod making conveyors.

As a rule, the aforementioned suction chamber is adjacent that side of an endless foraminous belt or the like which is disposed opposite the side serving to gather a stream of tobacco shreds. The suction chamber is apt to accumulate substantial quantities of tobacco dust within a relatively short interval of time. Such dust normally contains very small particles of tobacco leaves which normally adhere to the adjacent tobacco shreds on their way to the rod forming station but become separated from the shreds during the next-following processing of cigarettes of unit length or multiple unit length. The dust in the plenum chamber further contains minute particles of sand and/or rock as well as relatively small tobacco fragments which are more likely to be interlaced with desirable tobacco shreds of standard size and/or shape and which are less likely to readily penetrate through the openings of the endless foraminous belt.

The relatively small tobacco fragments develop in part during the making of tobacco shreds and in part during transport of shreds from the shredding station to the rod forming station, particularly during transport toward the foraminous belt. Some of the small fragments even penetrate into the openings of the foraminous belt and gather in the suction chamber. Additional relatively small tobacco fragments develop during transport of satisfactory shreds with the foraminous belt; thus, the end portions of a certain percentage of shreds penetrate into the openings of the belt to be sheared off the major portions of the respective tobacco shreds during separation of the respective portions of the tobacco stream from the foraminous belt.

In accordance with heretofore known procedures, all solid particles which happen to penetrate into the suction chamber are evacuated from the chamber with the air stream which enters the chamber by way of openings in the foraminous belt, which flows through the chamber, and which is evacuated by way of one or more outlets. The thus evacuated air is caused to flow into a central dedusting station of the entire cigarette making plant and the thus accumulated mass of dust and minute or relatively small tobacco shreds is thereupon converted into sheets or other configurations of reconstituted tobacco. Such procedure must be carried out by resorting to bulky and costly machinery and is expensive in spite of the fact that the reconstituted tobacco can be or is being reused for the making of smokers' products. For example, the sheet can be shredded and the thus obtained shreds are admixed to the shreds of the shower (i.e., to the shreds which are obtained as a result of comminution of tobacco leaf laminae).

U.S. Pat. No. 3,282,270 (granted Nov. 1, 1966 to Morris et al. for "TOBACCO-MANIPULATING APPARATUS")

discloses a method which involves segregation of tobacco dust directly at the cigarette rod making machine and immediate pneumatic reintroduction of separated dust into the shower of tobacco shreds advancing toward the foraminous belt of the pneumatic conveyor which converts the shower into a continuous tobacco stream. The introduction of dust into the shower is to be carried out by the shreds which constitute the shower, and retention of dust in the stream is to be effected by those shreds which already adhere to the exposed side of the foraminous belt.

A drawback of the just described patented proposal of Morris et al. is that only the relatively large particles of dust are intercepted by tobacco shreds at the foraminous belt. All or nearly all small particles of tobacco dust, sand and other foreign matter are free to reenter the suction chamber so that the air stream issuing from the suction chamber contains a continuously increasing percentage of dust and foreign matter. It is to be borne in mind that the shower of tobacco shreds contains and delivers to the tobacco stream forming station additional particles of tobacco dust, sand and other minute particulate material and that, sooner or later, all or nearly all such particles enter and circulate with the air stream which delivers the solid contents of the suction chamber to the shower of tobacco shreds advancing toward the foraminous belt.

OBJECTS OF THE INVENTION

An object of this invention is to provide a method which renders it possible to overcome the drawbacks of heretofore known proposals to remove tobacco dust and other undesirable particles from the mass of comminuted tobacco which is to be converted into one or more rod-like fillers in a cigarette making machine or the like.

Another object of the present invention is to provide a novel and improved method which renders it possible to recover and reuse acceptable fragments of smokable material which happen to penetrate into the suction chamber(s) of a machine for the making of one or more continuous tobacco-containing rods, such as a cigarette rod making machine.

A further object of the invention is to provide a method which reduces the likelihood or prevents the accumulation of large quantities of tobacco dust and like minute particulate material in the suction chamber(s) of a cigarette rod making or an analogous machine for the making of smokers' products.

An additional object of the instant invention is to provide a novel and improved method of achieving pronounced savings in acceptable smokable material in a machine for converting one or more showers of loose tobacco particles into one or more tobacco streams ready for conversion into rod-like tobacco fillers in a cigarette making or an analogous machine for the mass-production of rod-shaped smokers' products.

Still another object of the invention is to provide a novel and improved apparatus for the practice of the above outlined method in cigarette rod making and analogous machines.

A further object of the invention is to provide an apparatus which renders it possible to achieve substantial savings in smokable material which is processed in a machine for the making of cigarette rods and the like.

Another object of the invention is to provide an apparatus which can be installed with equal advantage in a machine for the making of a single continuous rod-shaped tobacco filler or for simultaneously turning out a plurality of such rods.

An additional object of the invention is to provide a novel and improved cigarette rod making machine.

Still another object of the invention is to provide a novel and improved arrangement for treating tobacco dust and other small particulate substances gathering in the suction chamber or chambers of a cigarette rod making or an analogous machine.

A further object of the invention is to provide novel and improved smokers' products wherein the rod-shaped smokable fillers contain tobacco dust in a distribution superior to that in presently known rod-shaped smokers' products containing recovered tobacco dust and/or smokable particles of similar size.

SUMMARY OF THE INVENTION

One feature of our invention resides in the provision of a method of building at least one stream of smokable material from a mixture containing randomly distributed relatively large first particulate material (such as standard-size shreds of tobacco leaf laminae) and randomly distributed relatively small second particulate material including a coarser or larger fraction and a finer or smaller fraction. The coarser fraction of the second particulate material can contain or consist of fragments of standard tobacco shreds (such fragments develop in the tobacco shredding machine and/or during travel of standard-size shreds from the shredding machine into the distributor or hopper of a cigarette maker and/or during transport from the hopper to the stream building station). The finer fraction can contain tobacco dust and/or minute fragments of tobacco shreds and/or foreign matter (e.g., small particles of sand and/or the like).

The improved method includes a plurality of steps including the step of advancing the mixture against one side of at least one moving belt or band forming part of a pneumatic conveyor and having a permeability such that the at least one belt intercepts and entrains the first material but permits at least some of the second material to pass therethrough. The belt preferably constitutes an endless belt having an elongated lower reach or stretch the underside of which is the aforementioned one side and the upper side of which is adjacent the open underside of a suction chamber which forms part of the pneumatic conveyor and attracts successive increments of the mixture (such mixture can constitute an ascending shower or column of randomly intermixed first and second particulate materials) and causes the first particulate material to adhere to the underside of and to advance with the lower reach of the endless belt while permitting at least some of the second particulate material to penetrate through the lower reach and to enter the suction chamber. The method further comprises the steps of at least partially segregating the coarser and finer fractions of the at least some second material from each other (such step follows the first step as well as the evacuation of the at least some second material from the suction chamber), and of admitting at least some of the thus segregated coarser fraction into the entrained first material at the one side of the at least one belt.

The finer fraction (or that part, if any, of such fraction) which has passed through the belt for the second time is or can be conveyed (e.g., in an air stream or another suitable carrier medium) from the plenum chamber and is separated from the carrier medium, e.g., in the central dust collecting plant of a cigarette making factory. This ensures that the thus recovered finer fraction cannot enter the atmosphere in the plant and can be put to use, e.g., for the making of sheets or films of reconstituted tobacco.

The at least one belt of the pneumatic conveyor is caused to move lengthwise in a predetermined direction, e.g., past a station at which the surplus of entrained first material is removed by a suitable trimming or equalizing device so that the remaining part of the mass of first material constitutes a continuous rod-like filler ready to be draped into a web of cigarette paper or other suitable wrapping or draping material. The advancing step of the improved method preferably includes feeding the mixture against the one side of the at least one belt in the form of a shower (especially an ascending shower) which is elongated in the predetermined direction so that the first material which is directed against and is intercepted by the one side of the belt forms an elongated tobacco stream which is ready to be trimmed and to be thus converted into a rod-like filler.

The segregating step can include directing at least some second material against the one side of the at least one moving belt.

Alternatively or in addition to the just discussed segregating step, the latter can comprise (or further comprise) directing the at least some second material (i.e., the second material which has already passed through the at least one belt) against the first material which is being entrained by the at least one belt. Otherwise stated, the admitting step can include pneumatically conveying at least some of the segregated coarser fraction into the entrained first material.

The advancing step of the improved method can include advancing the mixture against a relatively large first portion of the one side of the at least one belt, and the segregating step of such method can include directing the at least some second material against a relatively small portion of the one side of the at least one belt so that the finer fraction passes through the at least one belt and at least some of the coarser fraction moves with the at least one belt, and evacuating the finer fraction at the other side of the at least one belt. Such evacuating step can include entraining the finer fraction in an air stream and the improved method can further comprise the step of regulating the quantity of air forming the air stream to establish at the other side of the at least one belt a constant subatmospheric pressure. As already mentioned above, the belt is arranged to move in a predetermined direction (such as past the trimming or equalizing station), and the at least some second material is preferably directed against the one side of such belt upstream of the locus or loci of delivery of first material.

The segregating step of the improved method can include directing the at least some second material into the mixture advancing against the one side of the at least one moving belt. Such method can further comprise the step of converting the entrained first material into a rod-like filler, and such converting step can include removing a first portion (namely the surplus) of the entrained first material from a second portion at the one side of the at least one moving belt; the directing step preferably includes admitting the at least some second material into the second portion of the advancing first material, namely, into the portion which, upon completion of the trimmig or equalizing operation, constitutes the rod-like filler.

The improved method can further comprise the step of imparting to the at least some of the segregated second faction a component of movement in the direction of lengthwise movement of the mixture-receiving portion or reach of the belt; the segregated second fraction is preferably imparted such movement prior to the admitting step.

The improved method can be resorted to for simultaneously building at least two streams of smokable material. Such method can further include the step of breaking up the mixture into at least two flows, and the advancing step then includes simultaneously advancing each of the at least two flows against one side of one of at least two discrete moving belts. Still further, such method comprises the step of dividing the at least some second material, which has passed through the respective one of the at least two belts, into at least two masses prior to the segregating step. The just described embodiment of the improved method can further comprise the step of introducing each of the at least two masses into a different one of the at least two streams.

Another feature of the present invention resides in the provision of an apparatus for building at least one stream of smokable material from a mixture containing randomly distributed relatively large first particulate material (such as standard-size shreds of tobacco leaf laminae) and relatively small second particulate material (such as tobacco dust, small or very small portions of tobacco shreds, particles of sand and the like). The improved apparatus comprises at least one pneumatic conveyor having an endless running belt (including a first side and a second side) and at least one first suction chamber adjacent one side of the belt and having an outlet, and the apparatus further comprises means for feeding at least a portion of the mixture against the other side of the belt opposite the first suction chamber. The belt has a permeability such that it entrains the first material but permits at least some second material to pass into the first suction chamber. The improved apparatus also comprises means for evacuating second material from the first suction chamber by way of the aforementioned outlet, means for admitting the evacuated second material against the other side of the belt and/or against the first material being entrained by the belt, at least one second suction chamber disposed at the one side of the belt and serving to gather second material being furnished by the admitting means and having passed through the belt due to suction in the at least one second chamber, and means for drawing air and second material from the at least one second chamber.

The material admitting means and/or the means for drawing second material from the at least one second suction chamber can comprise one or more air conveying pipes, hoses and/or analogous conduits.

The volume of the at least one first suction chamber can greatly exceed the volume of the at least one second suction chamber.

The at least one pneumatic conveyor further includes means (such as one or more driven pulleys) for moving the belt in a predetermined direction, and the at least one second suction chamber can be provided or installed upstream of the at least one first suction chamber (as seen in the predetermined direction). Alternatively, the at least one second suction chamber can be provided in the at least one first suction chamber. The length of the at least one first suction chamber can exceed (e.g., it can be several times) the length of the at least one second suction chamber, as seen in the predetermined direction. Furthermore, the at least one second suction chamber can be spaced apart from the material admitting means, again as seen in the predetermined direction.

It is also possible to construct and install the means for admitting the evacuated second material in such a way that it discharges second material into the feeding means.

The means for admitting the evacuated second material can be arranged to discharge second material with a component of movement in the predetermined direction.

The apparatus can further comprise signal generating sensors and/or other suitable means for monitoring the pressure in the at least one first and/or in the at least one second suction chamber and/or means for regulating the pressure in the at least one second suction chamber. The regulating means can include control means for processing signals being furnished by the aforementioned sensor means and means for adjusting (when warranted) the air drawing means in response to the processed signals.

If the improved apparatus is utilized in a machine for simultaneously producing two or more rod-like fillers of smokable material, the transporting means includes at least two conveyors (each having an endless foraminous belt) and at least one second suction chamber for each conveyor. The feeding means of such apparatus includes means for dividing the mixture into several fractions, one for each conveyor, and means for feeding a discrete fraction of the mixture against the other side of the belt of each conveyor. The means for admitting evacuated second material then includes means for directing second material toward the other side of the respective belt at least substantially opposite the respective second suction chamber so that at least a substantial part of the finer fraction of second material having been discharged against the other side of the respective belt is drawn into the respective second suction chamber. In such apparatus, the means for admitting the evacuated second material against the other side of the respective belt and/or against the first material being entrained by the respective belt further includes adjustable means for breaking up second material into discrete masses, one for each of the directing means.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
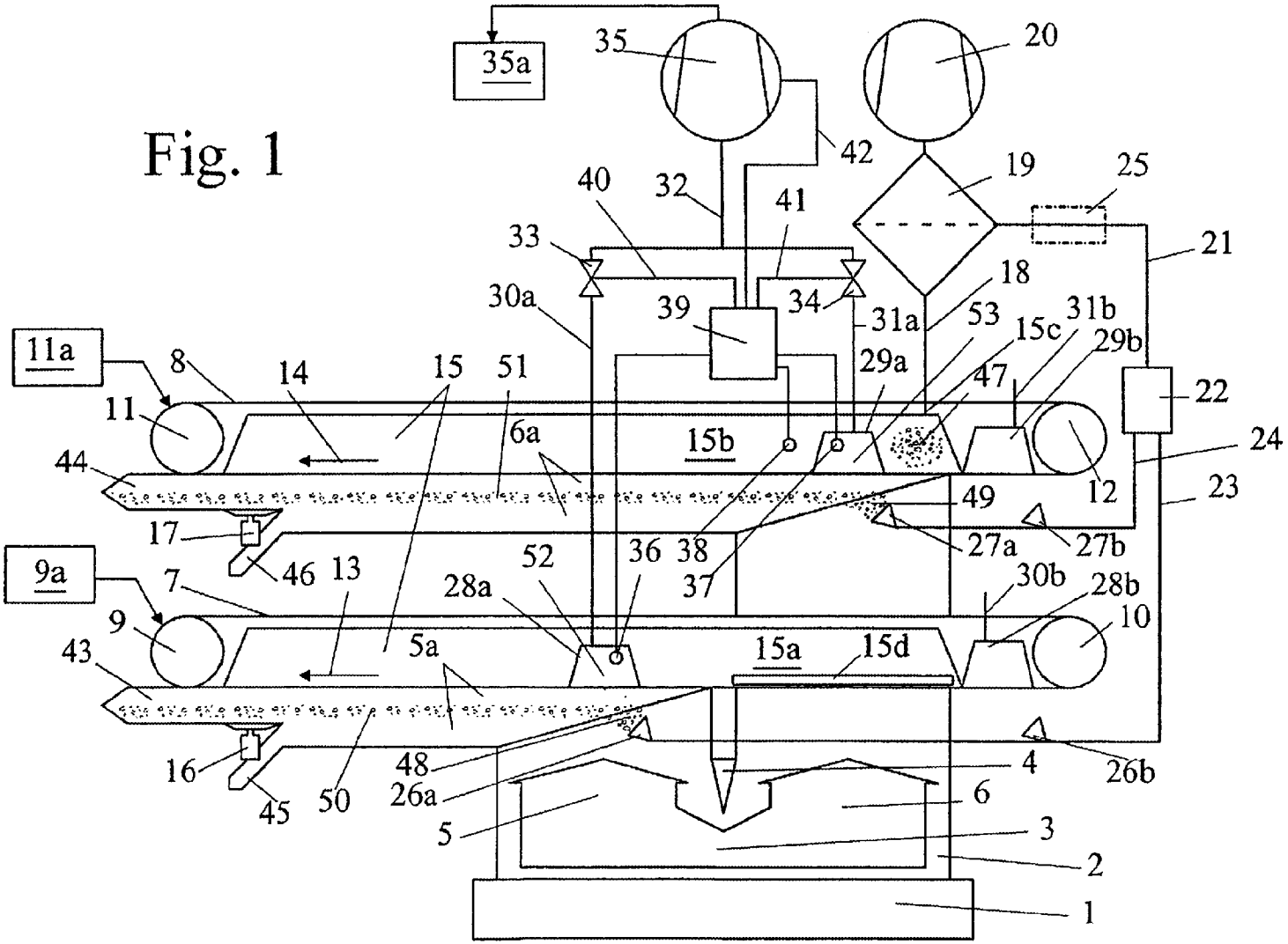
FIG. 1 is a schematic partly elevational and partly sectional view of an apparatus embodying one form of the present invention and being designed for use in a machine which is set up to simultaneously turn out a plurality of rod-shaped tobacco fillers.

FIG. 1 shows an apparatus which is designed to supply two discrete rod-shaped fillers 43, 44 of smokable material (primarily shredded tobacco leaf laminae) to two discrete wrapping mechanisms of a cigarette making machine of the type disclosed, for example, in aforementioned U.S. Pat. No. 5,125,419 granted Jun. 30, 1992 to Heitmann for "METHOD OF AND APPARATUS FOR MAKING PLURAL TOBACCO STREAMS". A cigarette making machine which can embody the apparatus of FIG. 1 is known as PROTOS 2 (distributed by the assignee of the present application).

The character 1 denotes a so-called distributor or hopper which is set up to feed a mixture containing relatively large first particulate material (such as customary tobacco shreds shown at 5*a* and 6*a*) and relatively small second particulate material (such as tobacco dust, particles of sand and/or metal and relatively small (comminuted) tobacco shreds) into a duct 2. The latter feeds a composite tobacco shower 3 containing the mixture of randomly distributed large first and small second particulate material into the range of a stationary separating tool 4 which divides the shower 3 into two discrete narrower showers 5 and 6. The ascending particles are attracted by a composite first suction chamber 15 having two sections or portions 15*a*, 15*b* each of which forms part of a discrete pneumatic conveyor. The two conveyors serve as a means for transporting the first particulate material and some of the second particulate material from the distributor 1 to the wrapping mechanisms of the machine embodying the improved apparatus.

The first conveyor comprises an endless foraminous running belt or strip 7 which is trained over pulleys 9 and 10. The substantially horizontal lower reach or stretch of the belt 7 advances in the direction of arrow 13 when at least one of the pulleys 9 and 10 is driven by a suitable prime mover, e.g., an electric motor or the like. FIG. 1 shows a prime mover 9*a* which is arranged to drive the front pulley 9.

The lower section 15*a* of the composite suction chamber 15 has an open underside adjacent the upper side of the lower stretch or reach of the foraminous belt 7. This lower section of the chamber 15 extends along the major part of the upper side of the lower stretch of the belt 7. As shown in FIG. 1, the lower section 15*a* extends from the front pulley 9 toward but slightly short of the rear pulley 10.

The construction of the illustrated upper pneumatic conveyor is or can be identical with that of the lower conveyor. Thus, the upper conveyor comprises an endless running belt or strip 8 which is trained over two pulleys 11, 12 and is set in motion (note the arrow 14) in response to starting of a prime mover 11*a* for the pulley 11. It is clear that the prime mover 9*a* can drive the pulleys 9, 11 of both pneumatic conveyors. The open underside of the upper section 15*b* of the suction chamber 15 extends along the upper side of the lower stretch or reach of the foraminous belt 8 all the way from the front pulley 11 toward but slightly short of the rear pulley 12.

The shower 5 which is separated from the shower 3 by the tool 4 ascends toward the underside of the lower reach of the belt 7 and its larger particulate material 5*a* is entrained in the direction of the arrow 13. The thus accumulated stream of large particles 5*a* is caused to advance past a conventional trimming or equalizing device 16 which removes the surplus 45 but permits the thus obtained rod-like filler 43 to advance into the aforementioned wrapping mechanism which confines the filler 43 in an elongated wrapper of cigarette paper or the like. Such wrapper and the filler 43 together constitute a continuous cigarette rod which is ready to be subdivided into a row of plain cigarettes of unit length or multiple unit length. The plain cigarettes are fed into a packing machine or into a so-called tipping machine which latter assembles the plain cigarettes with filter mouthpieces to form filter cigarettes of unit length or multiple unit length.

The right-hand shower 6 shown in FIG. 1 is caused (by the section 15*b* of the first suction chamber 15 and/or by a blower (not shown) of the distributor 1) to rise toward the underside of the lower reach of the endless belt 8 of the second pneumatic conveyor further including the pulleys 11, 12 and the prime mover 11*a*. The thus obtained stream (including the larger particles 6*a*) is advanced (in the direction of arrow 14) past a second trimming or equalizing device 17 which removes the surplus 46 but permits the thus obtained rod-like filler 44 to advance into a second wrapping mechanism wherein this filler is processed in the same way as the filler 43.

A certain percentage of relatively small second particles which are entrained by the larger particles 5*a* and 6*a* in the showers 5 and 6 is advanced with the lower reaches of the belts 7 and 8. The permeabilities of the belts 7 and 8 are such that the remaining relatively small second particles pass through the lower stretches of these belts and advance in the respective sections 15*a*, 15*b* of the first suction chamber 15 toward the outlet 15*c* of the section 15*b*. A suction generating material evacuating device 20 is set up to draw air and the remaining percentage 47 of the relatively small particles through the outlet 15*c*, through a conduit 18, and into a separator 19 which intercepts the solid contents of the air stream flowing from the outlet 15*c* to the device 20. The separator 19 can be a so-called Mahle Industriefilter Type SFK 1560 distributed by Knecht Filterwerke GmbH, Öhringen, Federal Republic Germany.

A conduit 21 conveys the separated solid material from the separator 19 to a dividing means 22 which breaks up the separated mixture of second particles into masses received by two discrete conduits 23, 24 for delivery back to the respective pneumatic conveyors.

The mixture 47 which is being evacuated through the outlet 15*c* of the section 15*b* of the composite plenum chamber 15 can contain some or all (small or minute) particles of tobacco (tobacco dust), sand or the like as well as a certain percentage of fragmentized tobacco shreds (i.e., of fragmentized particles of shreds of the type shown at 5*a* and 6*a*). The fragmentizing of shreds can begin during advancement of shreds from the shredding machine or machines into the distributor 1, during advancement of shreds in the showers 5, 6 and/or on impact against the undersides of lower stretches of the belts 7 and 8. For example, the end portions of certain shreds forming part of the accumulations shown at 5*a* and 6*a* penetrate into the openings of the belts and are broken off in response to impingement of the exposed portions of such shreds upon the accumulations 5*a* and 6*a* and/or vice versa. In accordance with a feature of the present invention, at least the relatively large fragments of tobacco shreds in the masses flowing through the conduits 23, 24 are recovered and immediately or delayedly introduced into the streams including the fillers 43, 44 and the respective surplusses 45, 46. This entails substantial savings in tobacco and contributes to the so-called fullness ("feel") of the finished plain cigarettes.

The reintroduced material is shown at 50 in the tobacco stream advancing with the underside of the lower stretch of the belt 7, and at 51 in the tobacco stream advancing with the underside of the lower reach of the belt 8. The distances between the lower stretches of the belts 7, 8 and the rotary knives of the respective trimming devices 16, 17 are such that the reintroduced materials 50, 51 form part of the corresponding rod-shaped fillers 43 and 44. In other words, the reintroduced materials 50 and 51 form part of cigarette rods which are obtained as a result of confining the fillers 43, 44 in webs of cigarette paper or other suitable wrapping material.

Figure 2:
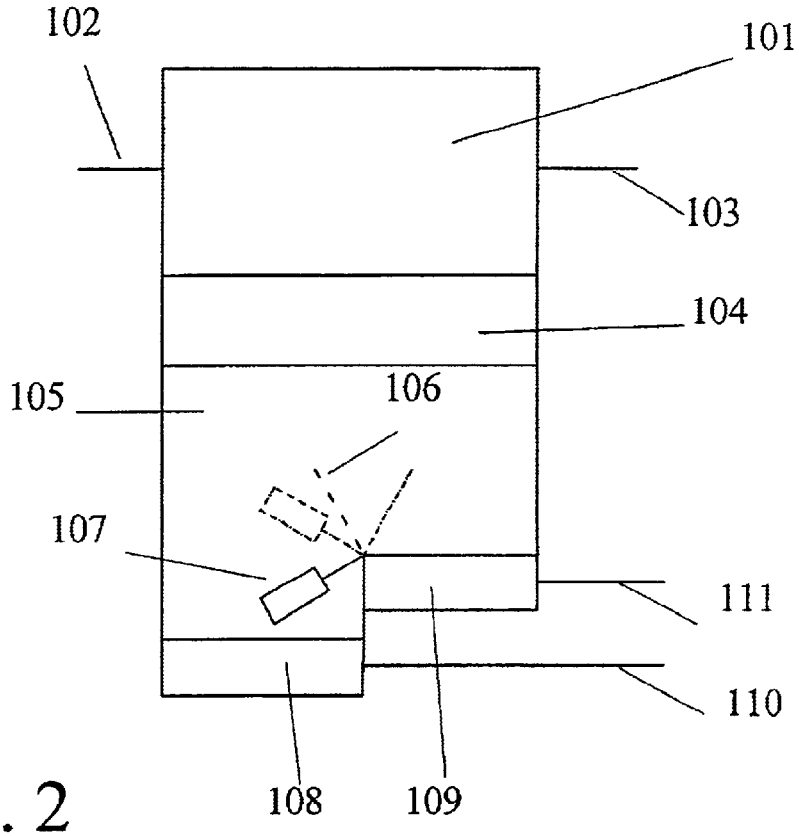
FIG. 2 is a enlarged fragmentary schematic sectional view of a device which can be utilized in the apparatus of FIG. 1 to divide a flow of segregated small particles of smokable material into two discrete masses.
Figure 3:
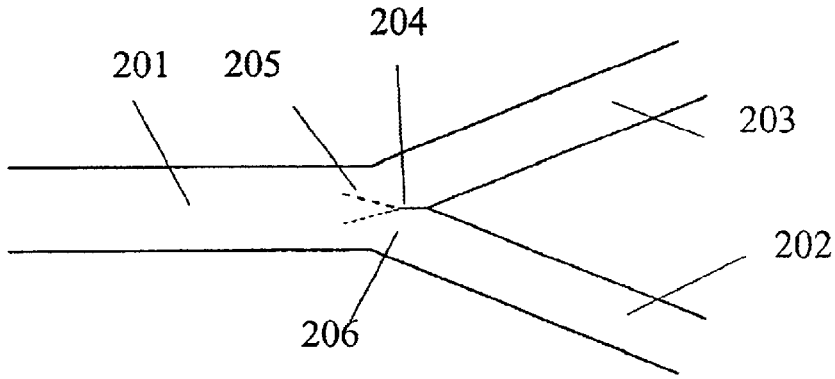
FIG. 3 is a similar view of a second device which can be put to use in lieu of the device shown in FIG. 2.

The manner in which the dividing means 22 splits the mixture 47 into two masses which are returned to the respective pneumatic conveyors (i.e., to the belts 7 and 8) will the described in full detail with reference to FIGS. 2 and 3.

The character 25 denotes in FIG. 1 an ejector which can be utilized in lieu of the dividing means 22 to expel solid particles from an air stream in the conduit 21.

The means for admitting second material (mixture 47) against the undersides of lower stretches of the belts 7, 8 and/or against the streams of first material already adhering (by suction) to the belts includes a total of four additional (second) suction chambers 28*a* (adjacent the upper side of the lower stretch of the belt 7 in the lower section 15*a* of the first suction chamber 15), 28*b* (adjacent the upper side of the lower reach of the belt 7 behind the section 15*a*, as seen in the direction of the arrow 13), 29*a* (adjacent the upper side of the lower reach or stretch of the belt 8 in the upper section 15*b* of the first chamber 15) and 29*b* (adjacent the upper side of the lower stretch of the belt 8 behind the section 15*b*, as seen in the direction of arrow 14). The second suction chambers 28*a*, 28*b*, 29*a* and 29*b* are much smaller than the suction chamber 15; in fact, the volume of each of the suction chambers 28*a*, 28*b* is a small fraction of the volume of the section 15*a*, and the volume of each of the suction chambers 29*a*, 29*b* is a small fraction of the volume of the section 15*b*. Furthermore, the length of each of the second suction chambers 28*a*, 28*b* (as seen in the direction of the arrow 13) is a small fraction of the length of the section 15*a*, and the length of each of the second chambers 29*a*, 29*b* is a small fraction of the length of the section 15*b* (as seen in the direction of the arrow 14).

The conduit 23 carries a material admitting nozzle 26*a* which directs the recovered mixture of second particles against the growing tobacco stream on the lower reach of the belt 7 in such direction that some of the thus reintroduced (second) material is propelled and/or is drawn toward the underside of the second suction chamber 28*a*. A second material admitting nozzle 26*b* of the conduit 23 discharges recovered second material in a direction toward the underside of the lower reach of the belt 7 and against the underside of the second suction chamber 28*b*.

The conduit 24 carries two material admitting nozzles 27*a*, 27*b* which respectively discharge second material against the growing tobacco stream at the underside of the lower reach at the belt 8 (as well as toward the underside of the suction chamber 29*b*). The means for drawing air and for thus evacuating the solid contents of the suction chambers 28*a*, 28*b* by suction comprises conduits 30*a*, 30*b* which discharge into a common conduit 32. The latter discharges into a second suction generating device 35 which segregates the solid particles from the gaseous carrier medium and discharges such second particles into a suitable disposing or processing unit 35*a*, e.g., into the central dust disposing or dedusting or processing unit 35*a* of the plant or factory in which the machine embodying the apparatus of FIG. 1 is being put to use.

The means for evacuating the solid contents of the second suction chambers 29*a*, 29*b* comprises conduits 31*a*, 31*b* leading to the conduit 32 which delivers the solid particles to the aforementioned suction generating device 35. The segregated solid particles are admitted into the dedusting unit 35*a*.

The apparatus of FIG. 1 further comprises a control unit 39 which receives signals furnished by a pressure sensor 36 in the second suction chamber 28*a*, by a pressure sensor 37 in the second suction chamber 29*a*, and by a pressure sensor 38 in the upper section 15*b* of the composite first suction chamber 15. The control unit 39 processes the signals from the sensors 36, 37, 38 and, when necessary, actuates the one and/or the other of the throttle valves 33, 34 or other suitable flow and/or pressure regulating means in the respective conduits 30*a*, 31*a*. The conductors for the transmission of processed signals from the control unit 39 to the valves 33 and 34 are respectively shown at 40 and 41. A conductor 42 connects the control unit 39 with the suction generating device 35.

The nozzle 26*a* is installed in that portion of the duct 2 which guides the shower 5, i.e., the mixture of smaller particles furnished by the conduit 23 can be fed directly into the shower 5. Analogously, the nozzle 27*a* discharges second material directly into the shower 6 advancing toward the underside of the lower reach of the belt 8.

The apparatus of FIG. 1 can be set up to operate with the nozzle 26*a* and/or 26*b* as well as with the nozzle 27*a* and/or 27*b*. The actual positions of the second suction chambers 28*a*, 28*b*, 29*a*, 29*b* and of the associated nozzles 26*a*, 26*b*, 27*a*, 27*b* can be different from those shown in FIG. 1, for example, if the shifting of one or more nozzles to different position(s) renders such nozzle or nozzles more readily accessible in a cigarette making machine or an analogous machine embodying the apparatus of FIG. 1. The latter shows the presently preferred positions of the nozzles and of the associated second suction chambers. As a rule, there is sufficient room between the distributor 1 and the belts 7 and 8 to accommodate the nozzles 26*a*, 26*b* and 27*a*, 27*b* in a manner to render them accessible for inspection, maintenance (such as cleaning) and/or replacement.

The second chambers 28*a*, 28*b* are installed slightly downstream of the respective nozzles 26*a*, 26*b* (as seen in the direction indicated by the arrow 13), and the same applies for the positions of the second chambers 29*a*, 29*b* relative to the nozzles 27*a*, 27*b* (as seen in the direction of the arrow 14). Therefore, the inclinations of all of the nozzles 26*a*, 26*b*, 27*a*, 27*b* are such that these nozzles discharge second material with components of movement in the directions indicated by the respective arrows 13 and 14.

The apparatus of FIG. 1 can be operated with the nozzles, 26*a*, 27*a*, with the nozzles 26*b*, 27*b*, with the nozzles 26*a*, 27*a* and 26*b*, 27*b*, or even with a single nozzle (26*a*, 26*b*, 27*a* or 27*b*), depending upon the percentage of small particles 47 in the showers 5 and 6 and/or upon the desired ratio of smaller particles to be removed from the showers 5 and 6. In many instances, the apparatus will be operated with the nozzles 26*a* or 26*b* and 27*a* or 27*b* open so that at least some smaller particles will be withdrawn from the shower 5 as well as from the shower 6.

The operation is as follows:

The distributor 1 of the cigarette rod making machine delivers a wide tobacco shower 3 into the duct 2 wherein the tool 4 divides the wide shower into two narrower showers 5 and 6. The showers 5 and 6 rise against the undersides of the lower reaches of the respective foraminous belts 7, 8 where the larger particles 5*a* and 6*a* accumulate to form two streams advancing in the directions respectively indicated by the arrows 13 and 14. The stream advancing with the belt 7 is equalized by the trimming device 16 which removes the surplus 45 but allows the thus obtained rod-like filler 43 to advance toward the respective wrapping mechanism. The stream advancing with the belt 8 is equalized by the trimming device 17 which removes the surplus 46 but permits the thus obtained rod-like filler 44 to advance with the belt 8 toward the corresponding wrapping mechanism. Wrapping mechanisms which can be utilized in combination with the apparatus of FIG. 1 are disclosed, for example, in commonly owned U.S. Pat. No. 4,721,119 granted Jan. 26, 1988 to Ludszeweit et al. for "ROD MAKING MACHINE WITH MEANS FOR ADJUSTING THE POSITION OF WRAPPING MATERIAL".

Suction in the composite first chamber 15 is selected in such a way that the streams including the larger particles 5*a* and 6*a* are attracted to the respective belts 7, 8 as well as that at least some smaller particles (shown in the upper section 15*b* of the chamber 15, as at 47) penetrate through the respective belts and flow with air toward and through the outlet 15*c*, i.e., into the evacuating conduit 18. Such smaller particles 47 are part of the streams 5 and 6 and penetrate through the growing streams at the undersides of lower stretches of the belts 7 and 8 and enter the respective sections 15*a*, 15*b* of the composite first suction chamber 15 to be evacuated with the stream of air flowing into the conduit 18 under the action of the suction generating device 20. The separator or filter 19 intercepts the smaller particles 47 and admits them into the conduit 21. The dividing means 22 breaks the flow of particles 47 ito two masses which are respectively admitted into the conduits 23 and 24.

If the nozzles 26*a*, 27*a* are open, they discharge the respective portions 48, 49 of the mixture 47 into the respective showers 5, 6 for entrainment toward the undersides of the lower stretches of the respective foraminous belts 7 and 8. The coarse fractions 50, 51 in the streams being entrained by the respective belts 7, 8 contain the larger constituents of the masses flowing in the conduits 23, 24 and being discharged by the respective nozzles 26*a*, 27*a*. Tobacco dust 52, 53 and other minute constituents of the masses issuing from the nozzles 26*a*, 27*a* can be attracted in part by suction in the respective sections 15*a*, 15*b* of the suction chamber 15 but primarily by suction in the respective second suction chambers 28*a* 29*a* and are withdrawn therefrom via conduits 30*a*, 31*a* to enter the dedusting unit 35*a* by way of the conduit 32 and suction generating device 35.

The particles 50, 51 constitute the coarser fractions of the mixtures being discharged by the nozzles 26*a* and 27*a*, and the particles 52, 53 constitute tobacco dust and other minute particles of similar size. The streams of tobacco shreds at the undersides of lower reaches or stretches of the belts 7, 8 intercept coarser particles of the mixture 47, e.g., fragments of broken-up tobacco shreds. Even though such coarser particles of the mixture 47 normally constitute or can constitute a relatively small percentage of the shower 3 being supplied by the duct 2 of the distributor 1, they nevertheless contribute significantly to the economy of operation of the cigarette rod making machine embodying the apparatus of FIG. 1. The smallest particles of the masses being supplied to the nozzles 26*a*, 27*a* via conduits 23, 24 penetrate through the respective tobacco streams and through the lower stretches of the respective belts 7, 8 to gather (at 52 and 53) primarily in the respective second suction chambers 28*a*, 29*a*. Such particles are evacuated into the dedusting unit 35*a* via conduits 30*a*, 31*a*, 32 and suction generating device 35.

If the nozzles 26*a*, 27*a* are closed but the nozzles 26*b*, 27*b* are free to discharge those portions of the mixture 47 which are respectively delivered by the conduits 23 and 24, at least some of the coarser fractions of the mixture 47 are intercepted and entrained by the lower reaches of the belts 7, 8 (for addition to the respective streams 43+45 and 44+46, and the finer fractions (corresponding to those shown at 52, 53) are permitted to penetrate into the second suction chambers 28*b*, 29*b*.

The signals from the pressure sensors 36, 37, 38 are processed by the control unit 39 which (when necessary)

initiates an adjustment of the valves 33 and 34 in order to increase or reduce the quantities of fine particles 52, 53 entering the dedusting unit 35*a* accordingly. Additional pressure sensors can be provided in the second suction chambers 28*b*, 29*b* for evacuation of larger or smaller quantities of finer or finest particles via conduits 30*b*, 31*b* when the nozzles 26*a*, 27*a* are closed but the nozzles 26*b*, 27*b* are free to discharge minute particles received from the respective conduits 23, 24. The valves mounted in the conduits 30*b*, 31*b* are not shown in FIG. 1.

It is also possible to open the nozzles 26*a*, 27*a* simultaneously with the nozzles 26*b*, 27*b*, to open three of the four nozzles, or to open only one of the four nozzles. This depends upon the composition of the shower 3 and/or upon the desired percentage of finer particles being admitted into the dedusting unit 35*a*.

The control unit 39 can be set up to operate the valves 33, 34 and the suction generating device 35 (via conductors 40, 41 and 42) in such a way that there are no abrupt changes of pressure at the boundaries between the second chambers 28*a*, 29*a* and the respective sections 15*a*, 15*b* of the first suction chamber 15.

The means 22 for dividing the second particles 47 being delivered by the conduit 21 into two masses which enter the conduits 23, 24 can be constructed and operated in a manner as shown in FIG. 2 or 3. FIG. 2 shows a conduit 102 (corresponding to conduit 21 shown in FIG. 1) which supplies a stream of air and the particles 47 into a dust separator 101. Cleaned air is evacuated via conduit 103, and a gate 104 transfers the separated solid particles 47 into a collecting receptacle 105. The latter is provided with ejectors 108, 109 which respectively deliver particles to the conduits 110, 111 corresponding to the conduits 23, 24 shown in FIG. 1. A pivotable partition 106 is provided to distribute the particles entering the receptacle 105 between the ejectors 108 and 109, i.e., between the conduits 110 and 111. A handgrip portion 107 (e.g., a lever) is provided to select the angular position of the partition 106 and hence the ratios of solid particles leaving the receptacle 105 and entering the ejectors 108, 109. The gate 104 can include or constitute a cell wheel which is rotatable about a fixed axis and has vanes or blades which transfer solid particles from the dust separator 101 into the collecting receptacle 105.

The manually operable handgrip portion 107 can be replaced with an electric motor or with any other suitable automatically operable device capable of properly selecting the positions of the partition 106.

The structure which is shown in FIG. 3 constitutes another presently prefered version of the separator or dividing means 22. A pneumatic conduit 201 (corresponding to the conduit 21 in the apparatus of FIG. 1) supplies a mixture (corresponding to the mixture 47 shown in FIG. 1) of finer and coarser smaller particles to a branch 206 serving to establish a connection between the discharge end of the conduit 201 and the intake ends of two conduits 202, 203 corresponding to the conduits 23, 24 shown in FIG. 1. A pivotable flap 204 at the junction of the conduit 201 with the conduits 202, 203 has an end portion 205 extending into the conduit 201 and serving to determine the distribution of the mass of particles arriving via conduit 201 into the masses of particles being admitted into the conduits 202 and 203. The flap 204 can be pivoted by hand (as in the embodiment of FIG. 2) or automatically, e.g., by an electric motor receiving signals from a control unit, not shown in FIG. 3.

Figure 4:
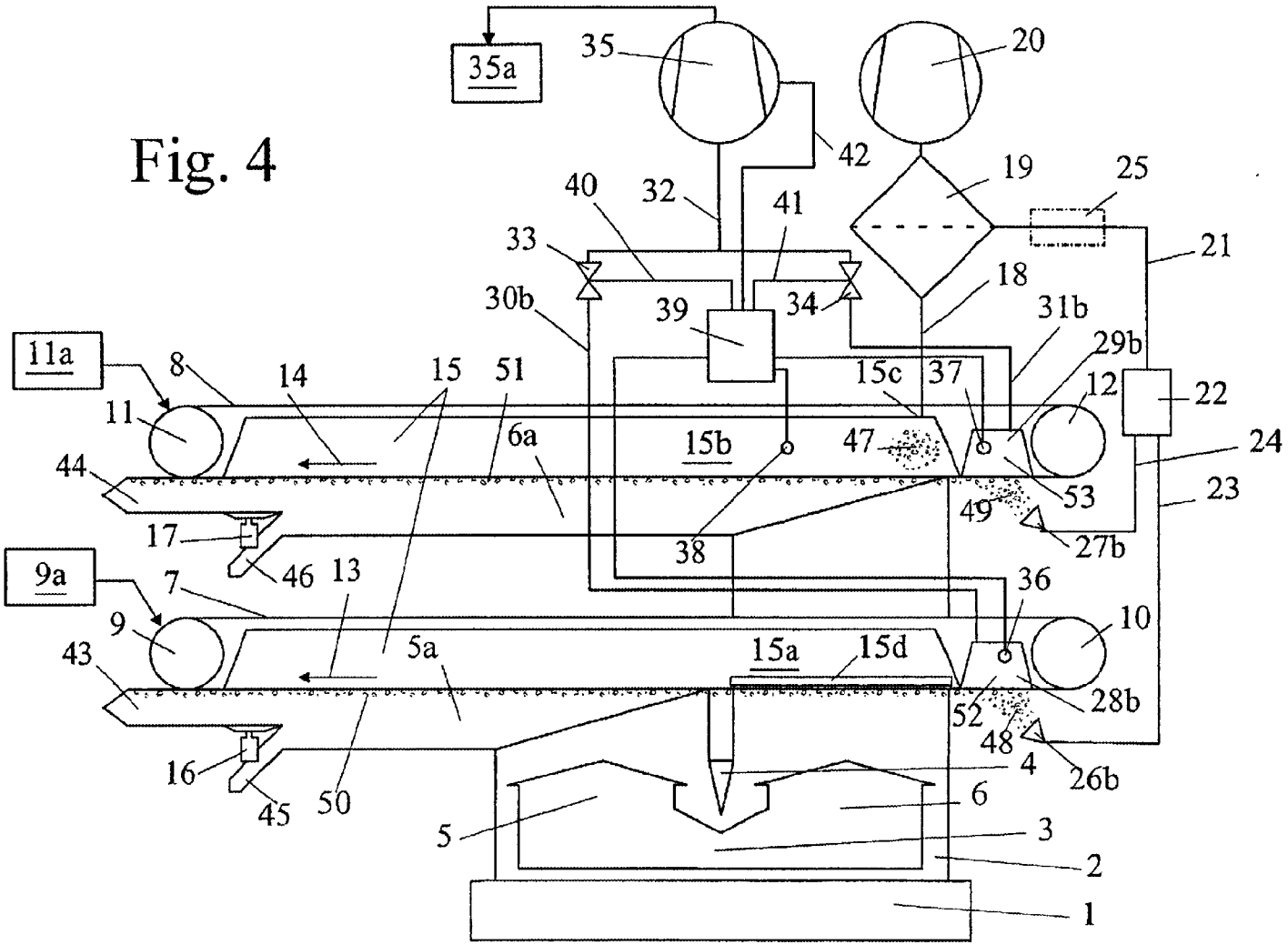
FIG. 4 shows an apparatus which is somewhat different from that shown in FIG. 1.

FIG. 4 illustrates an apparatus which constitutes a modification of the apparatus shown in FIG. 1. The main difference between these apparatus is that, in FIG. 4, the nozzles 26*a*, 27*a* and the corresponding second suction chambers 28*a*, 29*a* are omitted. The suction chambers 28*b*, 29*b* of FIG. 4 respectively contain fluid pressure sensors 36, 37 which transmit signals to the control unit 39. In all other respects, the apparatus of FIG. 4 is or can be identical with the apparatus of FIG. 1. The particles which are supplied by the nozzles 26*b*, 27*b* are classified only by the lower reaches or stretches of the respective foraminous belts 7, 8. Larger particles (such as acceptable-size fragments of tobacco shreds) are entrained by the respective belts 7, 8 to be admixed to the materials of the showers 5 and 6, respectively. The smallest particles (such as tobacco dust) penetrate through the belts 7 and 8, enter the second suction chambers 28*b*, 29*b*, respectively, and are evacuated by the suction generating device 35.

As a rule, the tobacco shower 3 furnished by the distributor (such as 1) of a cigarette rod making machine contains a relatively low percentage (e.g., about 5%) of small tobacco particles. It has been ascertained that the weight of such small tobacco particles approximates 50 kg per 8-hour shift per cigarette making machine. A substantial percentage of small tobacco particles consists of useful fragments of tobacco shreds, i.e., of smokable material which can form part of the stream including the rod-like filler 43 or 44. The remaining percentage of small tobacco particles consists of tobacco dust and fragments of mineral substances (such as sand). Under ideal circumstanes, only tobacco dust, sand and like minute particles would be permitted to enter the chamber 15 to be evacuated at 15*c*, separated from the gaseous carrier medium at 19, and prevented from reentering the shower 5 and/or 6 (and hence the suction chamber 15).

If the segregated particles 47 (which contain tobacco dust, sand as well as useful fragments of tobacco shreds) were simply returned into the showers 5 and 6, at least a substantial percentage of tobacco dust and sand would reenter the chamber 15 so that the percentage of dust in this chamber would rapidly increase. Repeated or continuous evacuation of air and dust at 15*c* would produce a progressively increasing quantity of dust which would circulate in the cigarette making machine. Added to the dust being continuously delivered by the shower 3, the recirculated dust would cause rapid overfilling of the machine with undesirable material.

The purpose of the second suction chambers 28*a*, 28*b*, 29*a* and 29*b* is to prevent the accumulation of excessive percentages of dust in the suction chamber 15. The second suction chambers are at least substantially sealed from the respective sections 15*a*, 15*b* of the first suction chamber 15, i.e., fine particles (such as 52 and 53) cannot escape from the respective second suction chambers (such as 28*a*, 29*a*) except by way of the conduits (30*a*, 31*a*) leading to the dedusting unit 35*a* via suction generating device 35. In other words, the particles 52, 53 cannot be readmitted into the suction chamber 15 because they cannot enter the conduit 21.

The only regions where small particles (such as sand and/or tobacco dust) can be caused to advance from the second suction chambers (such as 28*a*, 29*a*) into the first suction chamber 15 would be along the open undersides of the chambers 28*a*, 29*a*, with the respective foraminous belts 7, 8, and into the respective sections 15*a*, 15*b* of the first suction chamber 15. This is prevented (or the likelihood of such advancement of sand and/or tobacco dust is greatly reduced) by the simple expedient of regulating the pressure (suction) in the chamber 15 so that this pressure equals or at least approximates the pressure (suction) in the chambers 28*a*, 29*a*. Such equalization of pressures prevailing in the chambers 15, 28*a*, 29*a* brings about the additional advantage that it prevents the development of air streams flowing transversely and at the undersides of lower reaches of the belts 7 and 8; such transverse flows could affect the predictability of the buildups of tobacco streams at the undersides of the belts 7 and 8. The aforediscussed equalization of pressures can be achieved by appropriate adjustments of the throttle valves 33, 34 and/or of the suction generating device 35.

The undersides of the two sections 15*a*, 15*b* of the first suction chamber 15 and of the second suction chambers 28*a*, 28*b*, 29*a*, 29*b* communicate with the atmosphere by way of the lower reaches of the belts 7 and 8, respectively. In addition, air which enters the left-hand part of the section 15*a* and nearly the entire section 15*b* must flow through the partially or completely built up tobacco streams 43, 45, respectively. The nozzles 26*a*, 27*a* respectively deliver the mixtures 52, 53 against the undersides of the growing tobacco streams 43, 45 and 44, 46. Some fine fractions (tobacco dust and sand) of such mixtures can penetrate through the respective growing tobacco streams on their way into the sections 15*a*, 15*b* of the first suction chamber 15; however, the major parts of such fine fractions are attracted into the respective second suction chambers 28*a*, 29*a* and are evacuated therefrom via the respective conduits 30*a*, 31*a* and into the dedusting unit 35*a*, i.e., they cannot reenter the chamber 15. On the other hand, the larger fractions of the mixtures 48, 49 which are respectively delivered by the nozzles 26*a*, 27*a* are intercepted by the respective growing tobacco streams 43, 45 and 44, 46 to be entrained by the respective belts 7,8 and to form part of the rod-like fillers 43, 44.

Since the second chambers 28*a*, 29*a* are at least substantially sealed from the respective sections 15*a*, 15*b* of the first suction chamber 15, any tobacco dust and/or sand entering the chambers 28*a*, 29*a* is reliably prevented from reentering the chamber 15 so that the quantity of tobacco dust and/or sand in the chamber 15 does not increase in spite of recirculation of the mixture 47, namely primarily into the second suction chambers 28*a*, 29*a* via separator 19, conduit 21, dividing means 22, conduits 23, 24 and nozzles 26*a*, 27*a*.

The efficiency of the improved apparatus is surprisingly high in spite of the fact that any reusable smaller particles which happen to enter the second suction chambers 28*a*, 29*a* are not introduced into the tobacco stream 43, 45 and/or 44, 46. Thus, all tobacco particles which enter the chambers 28*a*, 29*a* are admitted into the dedusting unit 35*a* regardless of whether such particles contain components which are sufficiently large to warrant or justify introduction into the tobacco streams advancing toward the respective trimming devices 16, 17. However, the total quantity of useful tobacco particles in the accumulations 52 and 53 in comparison with those delivered by the showers 5 and 6 is very small or even negligible. The main reason is that the lengths of the second suction chambers 28*a*, 29*a* in comparison with those of the sections 15*a*, 15*b* (as seen in the directions respectively indicated by the arrows 13 and 14) are small or negligible.

It is to be borne in mind that the likelihood of entry of useful short or small tobacco particles (such as fragments of tobacco shreds) into the second chambers 28*a*, 29*a*, i.e., of a renewed penetration of such useful particles through the openings of the belts 7 and 8, is extremely low. For example, if the likelihood of penetration of reusable tobacco particles through the belts 7 and 8 to form part of the particles 47 is 10%, the likelihood of penetration of such particles (supplied by the nozzles 26*a*, 27*a*) into the second suction chambers 28*a*, 29*a* to form part of the mixture 52 and/or 53 is not more than 1%, i.e., about 99% of particles 52, 53 consist of tobacco dust and/or sand.

The preceding observations apply with equal or similar force for the mixtures which are supplied by the nozzles 26*b*, 27*b* against those portions of the belts 7, 8 which are not located below the sections 15*a*, 15*b* of the first suction chamber 15. Thus, the particles which enter the second suction chambers 28*b*, 29*b* (when the nozzles 26*b*, 27*b* are utilized or provided in the apparatus of FIG. 1) consist practically exclusively of tobacco dust and/or sand so that they need not be classified again but can be readily admitted (via conduits 30*b*, 31*b*) into the second suction generating device 35 and thence into the dedusting unit 35*a*.

It is possible that some of the particles which are supplied by the nozzles 26*a*, 27*a* bypass the respective second chambers 28*a*, 29*a* and reenter the respective sections 15*a*, 15*b* of the first suction chamber 15. It has been ascertained that the percentages of such particles (in comparison with those being supplied by the conduits 23 and 24) are small, negligible or actually or practically nil. Therefore, such possibility of undesirable passage of certain small particles (e.g., sand and/or tobacco dust) through the chamber 15 can be disregarded.

A comparison of the lengths of suction chamber sections 15*a*, 15*b* (as seen in the directions respectively indicated by the arrows 13 and 14) indicates that, in the absence of any undertakings to the contrary, the section 15*a* would be much more likely to receive substantial quantities of gaseous carrier medium than the section 15*b*. This could affect the pressures in the chamber sections 15*a* and 15*b*. The reason is that a substantial portion of the lower reach of the belt 7 is not overlapped by a growing or fully grown tobacco stream so that, in the absence of an effective undertaking to the contrary, suction in the section 15*a* could be well below that which is required to properly advance the tobacco stream 43+45. In order to facilitate proper regulation of air pressure in the chamber section 15*a*, the corresponding portion of the upper side of the lower reach of the belt 7 is overlapped by a panel, a sheet or an analogous air flow impeding device 15*d* which can be made of a plastic or other suitable material.

It is desirable to utilize an air flow impeding device 15*d* which does not completely prevent the flow of air therethrough, i.e., it is advisable to employ a device 15*d* which is sufficiently permeable to ensure that the suction prevailing in the chamber section 15*a* can attract acceptable smaller tobacco particles (such as fragments of tobacco shreds) issuing from the nozzle 26*b* when this nozzle is utilized in lieu of or in addition to the nozzle 26*a*. An air flow impeding device is not necessary at the nozzle 27*b* because the building zone for the stream 44+46 begins at the second suction chamber 29*b*. The device 15*d* replaces sealing devices which are utilized in certain conventional machines to completely block the flow of air through the adjacent portion of a foraminous belt.

By employing the device 15*d*, the belt 7 in the apparatus of FIG. 1 is capable of attracting relatively large tobacco particles issuing from the nozzle 26*b* and of entraining such particles into the actual tobacco stream building zone beginning at or even ahead of the suction chamber 28*a* and extending therefrom in the direction indicated by the arrow 13.

The air flow impeding device 15*d* can be omitted if the suction which is generated by the device 20 is sufficiently pronounced to ensure that the belt portion advancing between the suction chambers 28*a*, 28*b* shown in FIG. 1 can entrain acceptable tobacco particles from the orifice of the nozzle 26*b* to the location beneath the suction chamber 28*a*. Alternatively, the device 15*d* can be utilized jointly with a suction generating device 20 which (if necessary or desirable) can adequately attract acceptable tobacco particles issuing from the nozzle 26*b* so that such particles advance with the lower reach of the belt 7 and on to the tobacco stream building zone beginning at or even a little ahead of the nozzle 26*a*.

Figure 5:
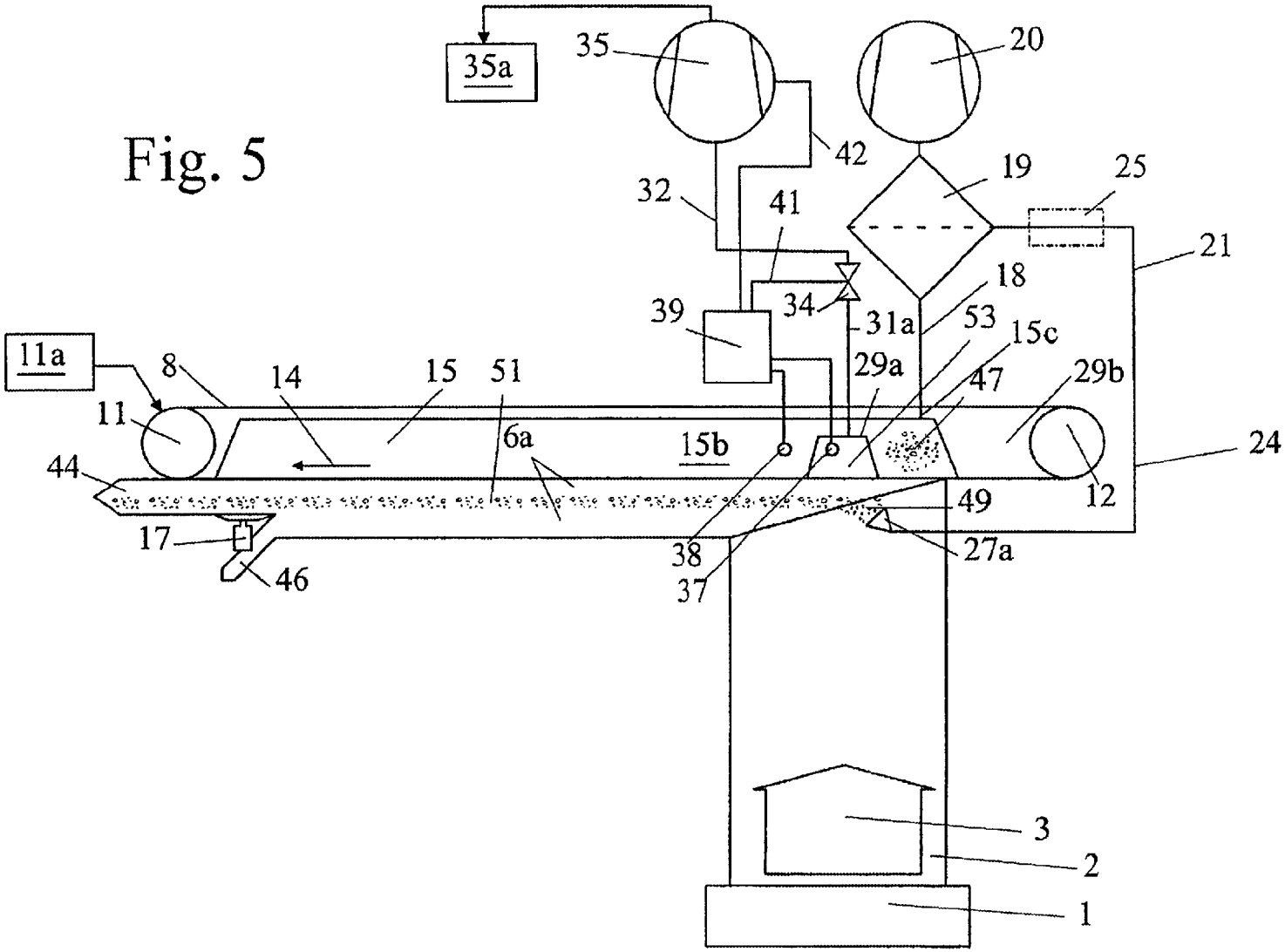
FIG. 5 shows an apparatus which constitutes a simplification of the apparatus shown in FIG. 1 or 4.

FIG. 5 shows an apparatus constituting a further simplification of the apparatus shown in FIG. 1 and a simplification of the apparatus shown in FIG. 4. This apparatus is designed for use in a cigarette making machine having a single wrapping mechanism, namely for the rod-like tobacco filler 44. The separator 22 of FIG. 1 is not necessary, and the same holds true for the conduits 23, 24, i.e., the conduit 21 delivers all segregated smaller particles to the nozzle 27*a*.

All such parts of the apparatus shown in FIGS. 4 and 5 which are identical with or analogous to those shown in FIG. 1 are denoted by similar reference characters.

The improved apparatus can be modified in a number of additional ways without departing from the spirit of the invention. For example, the sensors 36, 37 and 38 can be omitted if the apparatus of FIG. 1 is provided with means (not shown) for intermittently or continuously withdrawing samples of the solid particles gathering in the first suction chamber 15. The results of examination of such samples can be utilized to adjust the valve 33 and/or 34 in order to select appropriate subatmospheric pressures in the corresponding suction chambers.

Furthermore, the separator 19 can be dimensioned to separate solid particles from a fluid carrier being supplied by the conduit 18 as well as by one or more additional conduits supplying fluid laden with tobacco dust and/or fragments of tobacco shreds which are to be separated from fluid (normally air) and admitted to the stream(s) at the underside (s) of the lower reach of the belt 7 and/or 8. For example, the separator 19 can receive air from the area surrounding the cigarette making machine which embodies the structure of FIG. 1, provided that such air contains that percentage of useful smokable material which warrants the withdrawal of smokable material and its admission into one or more tobacco streams (such as the stream including the components 43, 45 at the underside of the lower reach of the belt 7 and/or the stream including the constituents 44, 46 at the underside of the lower reach of the belt 8).

The separator 22 can be combined with the separator 19 so that the conduit 21 can be omitted.

FIG. 1 shows that the widths of the flows of recovered smaller particles issuing from the nozzles 26*a* 27*a* are mere fractions of the widths of the corresponding showers 5, 6 (as seen in the directions respectively indicated by the arrows 13 and 14). This ensures that all of the particulate material issuing from the nozzles 26*a*, 27*a* and passing through the respective growing streams at the undersides of the lower reaches of the respective belts 7, 8, as well as through the respective belts, can be intercepted and gathered by relatively small second suction chambers 28*a*, 29*a*. The above applies with equal force for the nozzles 26*b*, 27*b* and the respective suction chambers 28*b*, 29*b*.

It is normally desirable to ensure that only certain categories (sizes) of particles contained in the mixtures 48, 49 be introduced into the tobacco streams advancing with the lower reaches of the belts 7 and 8. It is equally desirable to ensure that the dedusting unit 35*a* receive only tobacco dust and particles of a similar size. All this is accomplished in the apparatus of FIG. 1 by directing the mixtures 48, 49 into the showers 5 and 6 so that the segregation of reusable tobacco particles (such as fragments of tobacco shreds) can begin in the showers 5, 6 and continue at the respective stream building stations where the acceptable tobacco particles are intercepted by the growing tobacco streams and/or by the lower reaches of the respective foraminous belts 7, 8. Those small particles which are admitted by the nozzles 26*a*, 27*a* and are drawn into the respective second suction chambers 28*a*, 29*a* are of proper size to be conveyed into the dedusting unit 35*a*. However, a certain percentage of such smaller particles is intercepted by the respective tobacco streams and advances therewith toward the respective trimming devices 16, 17. Supplying of tobacco streams with a surplus (such as those shown at 45 and 46) is desirable and advantageous because, once the surplus is removed, the remaining portions 43, 44 of the tobacco streams invariably constitute two rod-like fillers having constant cross sections throughout and being convertible into parts of cigarettes having constant diameters and densities. Such parameters contribute to the quality of the rod-shaped smokers' products.

In a standard cigarette making machine, the filler 43 or 44 constitutes about two thirds of the stream including the components 43, 45 or 44, 46 of the respective tobacco streams, i.e., the trimming devices are normally positioned to remove surplusses 44,46 each of which constitutes one-third of the tobacco stream being advanced by the respective belt 7, 8. As already mentioned above, and as shown in FIG. 1, the recirculated (medium sized) tobacco particles 50 and 51 are admitted into those portions of the tobacco streams which ultimately constitute the rod-like fillers 43, 44.

Though it is possible to install the nozzles 26*a*, 27*a* in the respective showers 5, 6 at a considerable distance from the respective belts 7, 8, it is normally preferred to place such nozzles close to or into immediate proximity of the undersides of lower reaches of the respective belts 7, 8; this ensures that the second suction chambers 28*a*, 29*a* can gather all or nearly all small particles which should be delivered to the dedusting unit 35*a*. As already mentioned hereinabove, the positions of the nozzles 26*a*, 27*a* relative to the respective second suction chambers 28*a*, 29*a* are selected, at least to a certain extent, with a view to ensure that the nozzles are readily accessible in a cigarette making or an analogous machine which can employ apparatus of the present invention. The selected orientations of the nozzles 26*a*, 27*a* (as well as 26*b*, 27*b*) in such a way that the material issuing from their orifices has a component of movement in the direction of the arrow 13 or 14 ensure more satisfactory entrainment of small tobacco particles by the tobacco streams accumulating at the undersides of the lower reaches of the belts 7 and 8.

An important function of the control unit 39 and of the associated sensors (including those shown at 36, 37 and 38) is that it ensures the establishment of an at least substantially constant pressure along the upper sides of lower reaches of the belts 7 and 8. This is achievable in a simple and efficient manner by regulating the rate of evacuation of air via conduits 30*a*, 31*a*.

The widths of the second suction chambers 28*a*, 28*b* and/or 29*a*, 29*b* (as seen in the directions indicated by the respective arrows 13, 14) preferably exceed the widths or the diameters of the outlets of the respective nozzles 26, 27*a* and/or 26*b*, 27*b*. This enhances the ability of the second suction chambers to gather the small particles which are to be conveyed to the dedusting unit 35*a*.

It is clear that the two suction conveyors shown in FIGS. 1 and 4 need not be installed at two different levels and above each other. For example, these conveyors can be installed at the same level (see the aforementioned U.S. Pat. No. 5,125,419 to Heitmann). Furthermore, and as already mentioned hereinabove, the apparatus of FIGS. 1 and 4 can be utilized with practically any selected, desired or required number of nozzles, e.g., only with the nozzles 26*a*, 27*a*, with a single nozzle (26*a*, 27*a*, 26*b* or 27*b*), with three nozzles, or with four or more than four nozzles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making cigarettes or the like and, therefore, such adaptations should and are intended to be comprehended within the meaning and range of equivalence of the appended claims.

What is claimed is:

1. A method of simultaneously building at least two stream of smokable material from a mixture containing randomly distributed relatively large first particulate material and randomly distributed relatively small second particulate material including a coarser fraction and a finer fraction, comprising the steps of:

advancing the mixture against one side of at least one moving belt forming part of a pneumatic conveyor and having a permeability such that the belt entrains the first material but permits at least some of the second material to pass therethrough;

thereupon at least partially segregating the coarser and the finer fractions of the at least some second material from each other;

admitting at least some of the segregate coarser fraction into the entrained first material;

breaking up the mixture into at least two flows, and wherein said advancing step includes simultaneously advancing each of the at least two flows against one side of one of at least two discrete moving belts; and dividing the at least some second material which has passed through the at least two belts into at least two masses prior to said segregating step.

2. The method of claim 1, further comprising the step of introducing each of the at least two masses into a different one of the at least two streams.

3. A method of building at least one stream of smokable material from a mixture containing randomly distributed relatively large first particulate material and randomly distributed relatively small second particulate material including a coarser fraction and a finer fraction, comprising the steps of:

advancing the mixture against one side of at least one moving belt forming part of a pneumatic conveyor and having a permeability such that the belt entrains the first material but permits at least some of the second material to pass therethrough;

thereupon at least partially segregating the coarser and the finer fractions of the at least some second material from each other; and admitting at least some of the segregated coarser fraction into the entrained first material, wherein said advancing step includes advancing the mixture against a relatively large first portion of the one side of the at least one belt and said segregating step includes directing the at least some second material against a relatively small second portion of the one side of the at least one belt so that the finer fraction passes through the at least one belt and the coarser fraction moves with the at least one belt, and evacuating the finer fraction at a side opposite the one side of the at least one belt.

4. The method of claim 3, wherein said evacuating step includes entraining the finer fraction in an air stream and further comprising the step of regulating the quantity of air in the air stream to establish at the other side of the at least one belt a constant subatmospheric pressure.

5. The method of claim 3, wherein the belt is arranged to move in a predetermined direction and the at least some second material is directed against the one side of the belt upstream of delivery of first material, as seen in said predetermined direction.

* * * * *